United States Patent [19]

Zagara et al.

[11] 4,103,829

[45] Aug. 1, 1978

[54] PORTABLE OXYPROPANE TORCH

[75] Inventors: Frank A. Zagara, Pittsford; John M. Nelson, Rochester, both of N.Y.

[73] Assignee: Bernzomatic Corporation, Rochester, N.Y.

[21] Appl. No.: 740,470

[22] Filed: Nov. 10, 1976

[51] Int. Cl.[2] ..... F23D 13/04

[52] U.S. Cl. ..... 239/304; 239/413; 431/344; 431/345

[58] Field of Search ..... 431/344, 345; 266/48; 239/304–307, 303; 222/2, 3

[56] References Cited

U.S. PATENT DOCUMENTS

| | | | |
|---|---|---|---|
| 2,235,792 | 3/1941 | Bauman | 16/116 |
| 2,728,212 | 12/1955 | Costello | 431/345 |
| 2,831,607 | 4/1958 | Bendt | 222/3 |
| 3,246,849 | 4/1966 | Aske | 239/304 |
| 3,388,962 | 6/1968 | Baumann et al. | 431/344 |
| 3,575,319 | 4/1971 | Safianoff | 239/304 |
| 3,994,674 | 11/1976 | Baumann et al. | 431/344 |

FOREIGN PATENT DOCUMENTS

| | | | |
|---|---|---|---|
| 150,939 | 9/1935 | Austria | 239/304 |

*Primary Examiner*—Carroll B. Dority, Jr.

*Attorney, Agent, or Firm*—Burgess, Dinklage & Sprung

[57] ABSTRACT

A portable hand-held oxypropane torch comprising a generally rectangular carrier member supporting an oxygen valve and a propane valve and having an integral handle connected thereto. The oxygen valve is connected in fluid communication to a nozzle conduit. The propane valve is connected to a propane conduit which is connected in gaseous fluid communication with said nozzle downstream from the point where the oxygen valve is connected to the nozzle conduit. The nozzle conduit has a downwardly inclined end portion terminating in a nozzle.

11 Claims, 4 Drawing Figures

4
6
8
10
12
14
16
18
20
22
24
26
28
30
32
34
PROPANE
38
OXYGEN
36

4
6
32
34
PROPANE
38
OXYGEN
36

PORTABLE OXYPROPANE TORCH

BACKGROUND

This invention relates to an oxypropane torch of the type that can be hand held. This invention is particularly concerned with an oxypropane torch having independent valve means for an oxygen cylinder and a propane cylinder wherein the valves to which the respective cylinders are attached are supported by a common or unitary carrier plate.

Oxypropane torches are broadly known. These torches generally include sources of oxygen and propane connected to a torch head via flexible hoses. This is a cumbersome arrangement. Also because both liquid and vapor propane are present in a propane cylinder, the liquid phase can enter the valve (commonly referred to as "sloshing") which chokes off the oxygen supply causing a flame out.

SUMMARY

The present invention provides a simple, hand-held oxypropane torch. More particularly, the invention provides a hand-held, portable, unitary oxypropane torch having separate valve means for the oxygen and propane. The torch of the present invention broadly includes a generally rectangular, flat, one-piece carrier member supporting an oxygen valve and a propane valve and having an integral handle connected thereto. The oxygen valve is connected in fluid communication with a nozzle conduit. In turn, the propane valve is connected to a propane conduit which is in fluid communication with the nozzle conduit downstream of the oxygen valve. The nozzle conduit terminates in a downwardly inclined end portion which, in turn, terminates in a nozzle. The propane valve is positioned in generally linear alignment with respect to the oxygen valve on the carrier.

DESCRIPTION OF THE DRAWINGS

The invention can be more readily understood and appreciated when reference is made to the accompanying drawings in which.

DESCRIPTION

Figure 4:
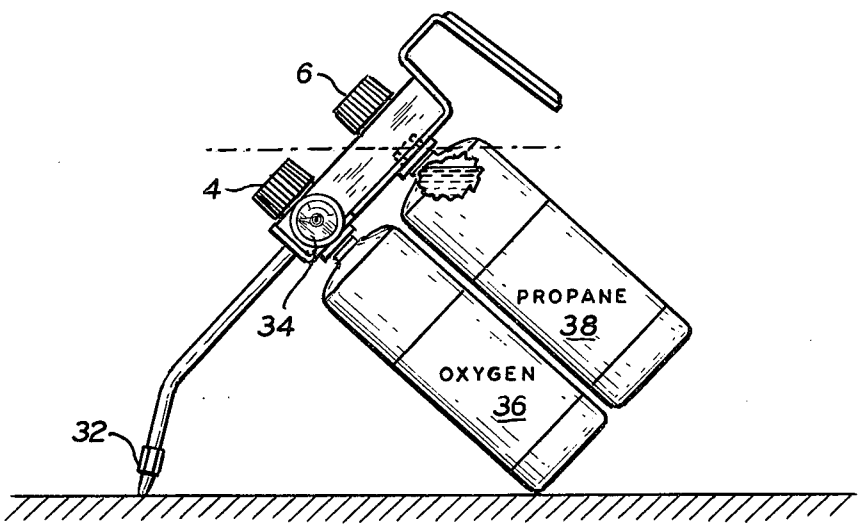
FIG. 4 is a view showing the disposition of the oxypropane torch when the same is tilted such that the nozzle abuts a planar surface.

The nozzle and the nozzle conduit are dimensioned such that when the torch is tipped forward on a flat surface without undue motion which would cause sloshing, liquid propane in the propane cylinder will not enter the propane valve. As shown in FIG. 4, the nozzle limits forward tipping of the torch when the oxygen cylinder remains in contact with the flat surface.

While different types of valve assemblies can be employed for the respective valves in the oxypropane torch of this invention, it is preferred that the oxygen valve comprise a valve body having an inlet adapted to receive oxygen from a container, an outlet, a diaphragm chamber and a valve chamber positioned between the inlet and outlet and communicating therewith and with the diaphragm channel. The valve includes a flexible diaphragm in the diaphragm chamber, the inner side of which is subjected to the pressure at the outlet while the outer side of which is subjected to ambient pressure. The oxygen valve includes a tire core regulator valve seeded in the valve chamber and adapted in the closed position to cut off the flow of gas therethrough. The valve also includes a valve stem connected to the tire core valve and adated to be actuated by the inner side of the diaphragm. An actuating spring retainer is positioned to contain a spring against the diaphragm in such a manner that the diaphragm operates to perfect movement of the valve from full open to full closed. Stop means are provided associated with the spring retainer and adapted to restrict the upward movement thereof. The valve includes a finger adjustable control knob operated on the retainer and adapted to permit graduated positioning thereof at positions intermediate the full open and full closed positions.

The torch preferably has a nozzle conduit which is substantially straight and joins the downwardly inclined end portion at an angle between 90° and 180° preferably 120°–160°.

The propane valve can be of simpler construction owing to the unique relationship of the nozzle conduit, inclined end portion and nozzle itself.

The oxygen valve preferably has attached thereto an externally positioned pressure gauge for measuring and displaying the pressure in a container of oxygen attached to the oxygen valve.

Generally the propane valve will comprise a tap connection for a cylinder of propane which has an elongated hollow stem forming a gas inlet in defining a pressure contact for opening actuation of the closure valve of the propane cylinder. A gas outlet is provided. Between the gas inlet and gas outlet there is positioned an adjustable shut-off valve generally in the form of a standard needle valve.

The carrier member is one piece and flat and has at opposed ends thereof integral upstanding or vertical members which tend to cover and protect at least a portion of the sides of the oxygen and propane valves. Thus, the carrier member besides providing a compact portable assembly also protects the oxygen and propane valves against damage from rough handling.

The handle is integral with the rear vertical member of the carrier and descends therefrom. The handle preferably carries a heat insulating material. The torch can have a rectangular housing disposed over the oxygen and propane valves leaving only the regulating knobs showing. The housing is mechanically attached to the carrier.

Referring to the drawings, the torch of the invention includes a carrier plate 2 which supports an oxygen valve 4 and a propane valve 6. The carrier plate is one piece and has apertures for the valves 4 and 6. A front raised member 8 and a rear raised member 10 (FIG. 3) are integrally formed with the carrier. The carrier has a housing 12 disposed over the valve bodies 4 and 6 except that the knobs 14 and 16 of the respective valves are disposed above the housing 12. The housing 12 and end portions 8 and 10 protect the valve bodies from damage.

Integral and coformed with the rearward raised member 10 is a generally horizontal member 18 which, in turn, terminates in a downwardly descending handle 20 to which is attached a heat insulated material 22 by means of screws 24 and 26. These screws can be replaced by rivets or the like.

The oxygen valve 4 has attached thereto a nozzle conduit 28 which, in turn, terminates in gaseous fluid communication with a downwardly descending portion 30 which is also tubular so as to permit gaseous flow therethrough. The downwardly descending portion 30 terminates in a nozzle 32. The nozzle conduit 28 joins the downwardly descending portion 30 by forming an angle A. Angle A is generally an angle of greater than 90° and less than 180° preferably 120°–160°.

The oxygen valve preferably has attached thereto an exteriorly mounted gauge 34 to permit the user to read the pressure of the oxygen in the oxygen tank connected thereto.

Figure 3:
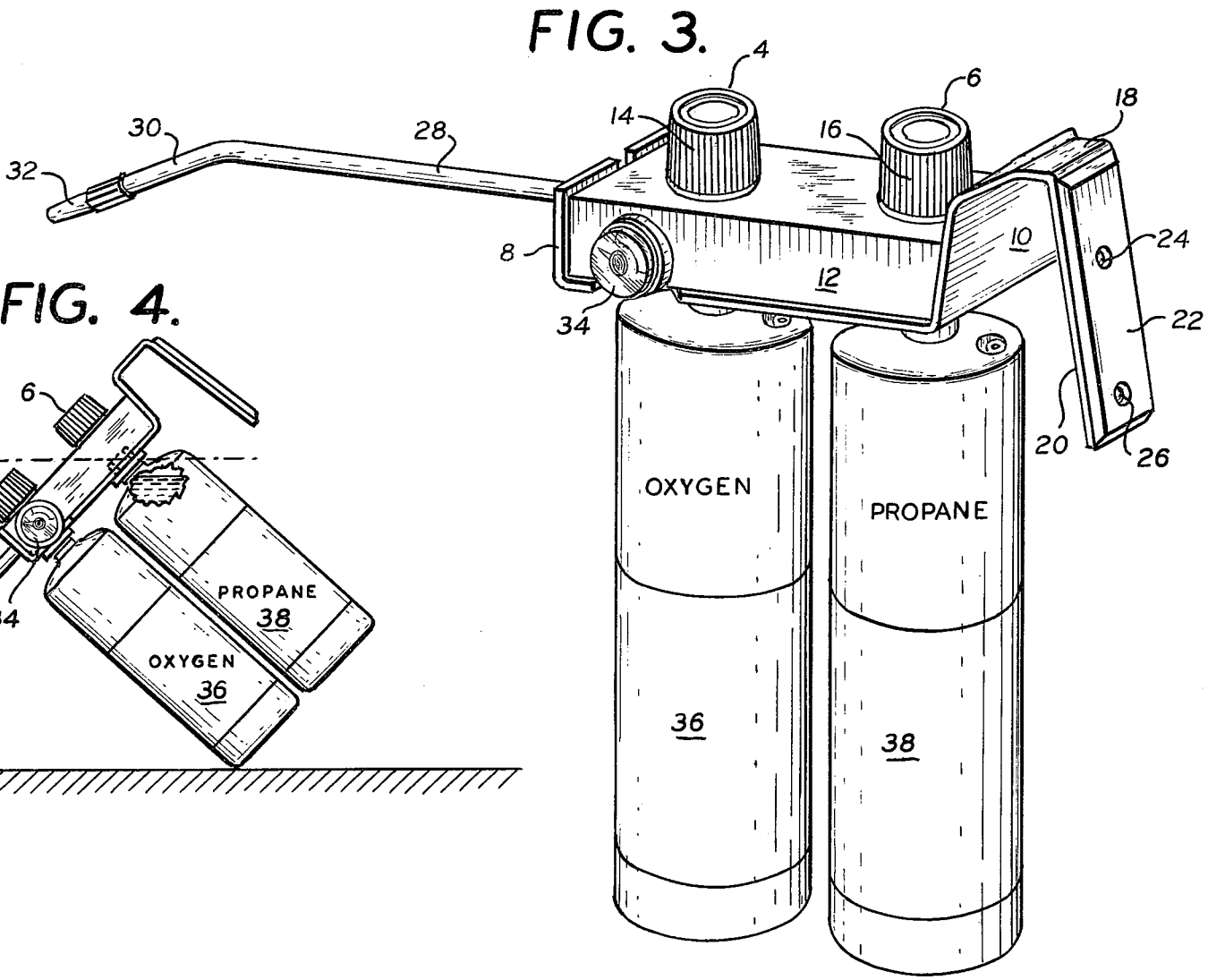
FIG. 3 is an isometric view of the apparatus of the invention wherein oxygen and propane tanks have been secured to the respective valve.

The oxygen valve 4 generally comprises a valve body 67 and a rotatable knob 63 which is mounted thereon. The valve body has an outlet 73 for connecting the valve to the nozzle conduit 28. The inlet at 75 is threaded so as to permit attachment of the oxygen cylinder 36 (FIG. 3). This inlet contains a stem 72 to actuate the usual cartridge valve in the oxygen cylinder.

A tire core valve 69 (FIG. 1) is located in a valve chamber positioned between the inlet and outlet passageways. Valve 69 has an actuating stem 74 which extends upwardly then gauges the regulator diaphragm which, as shown, has guides 68*a* and 68*b* affixed thereto which for manufacturing simplicity are identical, although the recess therein is only used on one side to center the valve stem 74, and the shoulder thereof is only used on the other side to center the actuating spring 64.

The diaphragm 66 is held in the diaphragm chamber by means of a threaded retainer 62 acting against a sealer washer 65. The retainer or stop 62 is desirably frozen into position by the application of a stud-lock compound on anaerobic plastic adhesive for the external threads thereof.

Figure 1:
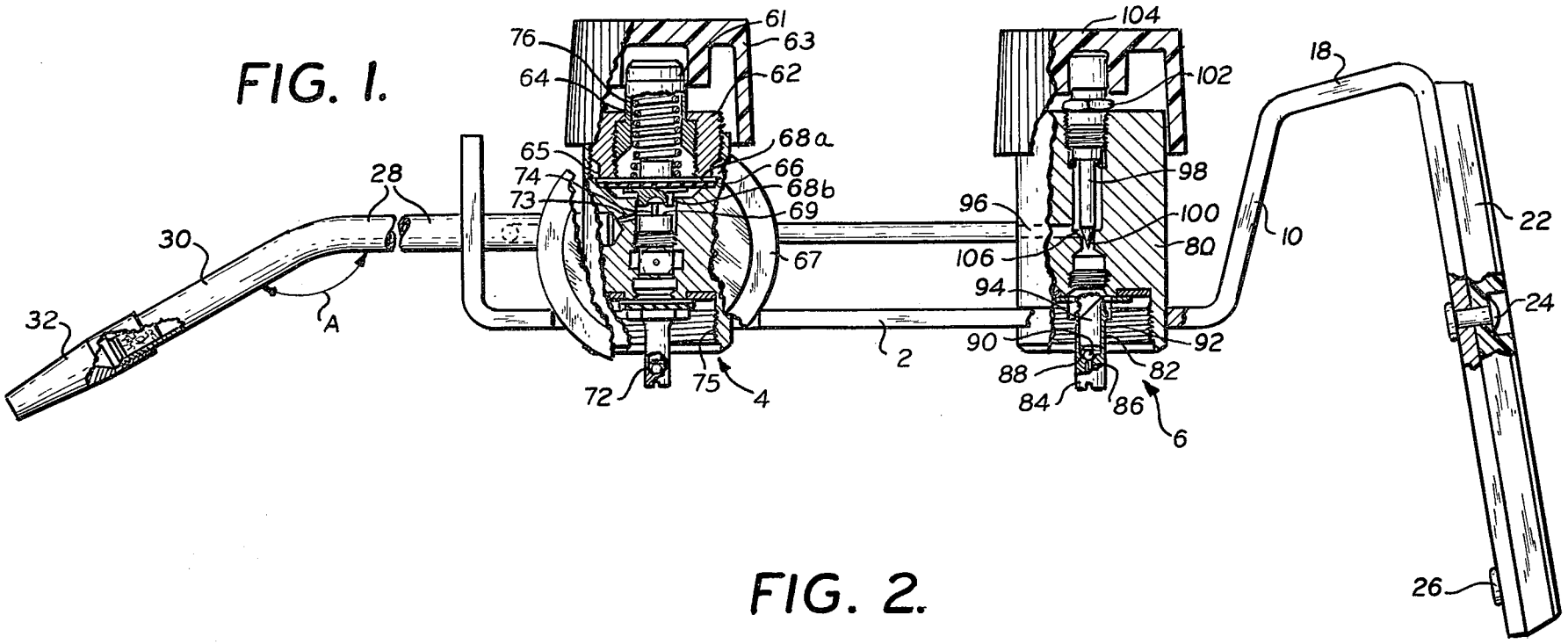
FIG. 1 is a side elevational view partially broken away of an oxypropane torch according to the invention with the oxygen and propane and cylinders removed.

The regulator diaphragm 66 is shown in detail in FIG. 1 wherein the same is in closed position wherein there is a force acting on stem 74. The upper side thereof is disposed to the ambient atmosphere via opening 76 and the gap between the knob 63 and the valve body.

The control knob 63 is attached to the upper part of spring retainer 61, as by a press fit after the spring retainer 61 is adjusted to the maximum pressure control point, which thereafter prevents any high pressure control adjustment and disassembly of the valve without considerable effort. This arrangement is particularly advantageous in the oxypropane torch of the invention.

The spring retainer 61 is threadably mounted in stop 62. By rotation of knob 63 the position of the retainer and thus the compression of spring 64 can be adjusted to thereby vary the action of the diaphragm on the valve 69 and modulate the flow of gas therethrough.

As indicated above, the construction of the propane valve can be simpler owing to the physical interrelationship of the oxygen and propane valves, as well as the nozzle conduit and the downwardly tapering end portion connected thereto. Again, referring to FIG. 1, the propane valve comprises a valve body 80. Within the valve body 80 there is a chamber 82 which houses at the lower end thereof the usual tap 84 for tapping into the seal of the propane cylinder. Tap 84 contains a central conduit 86 which joins a funnel-shaped conduit 88. Gas entering conduit 86 displaces the ball 90 upwardly to permit gas to flow into the annular channel 92 about a centrally disposed mandrel 94. The gas passes through the annular chamber 92 to enter chamber 82. The valve body 80 comprises an outlet 96. Disposed between the inner chamber 82 and the outlet 96 is a needle valve comprising needle shaft 98 and needle point 100. The needle shaft 98 carrying the needle point 100 is secured by fastening means 102 to a rotatable 104. Rotation of knob 104 allows for vertical movement of the needle shaft 98 whereby to open or close the passageway 106 between the inner chamber 82 and the outlet 96.

Figure 2:
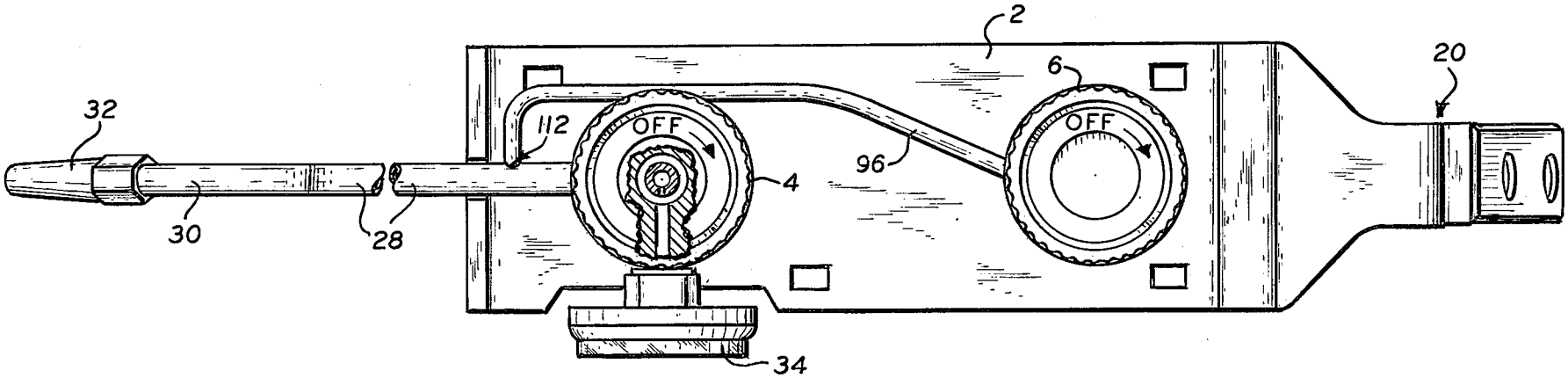
FIG. 2 is a plan view of the apparatus of FIG. 1.

Referring to FIG. 2, it will be appreciated that the outlet 96 is coformed with a propane conduit which enters the nozzle conduit at 112 at the side thereof.

By such a construction, the opening of the oxygen valve initially followed by opening of the propane valve allows the oxygen to aspirate the propane gas through the outlet 96 so as to enter the nozzle conduit 28. The relationship of the respective conduits, valves and cylinders insures a continuous operation even when the apparatus is tilted without undue motion which would cause sloshing.

Referring to FIG. 4, it is seen therein that when the device is tilted so as to dispose the nozzle 32 against a flat substrate, the liquid level within the propane tank 38 stays below the stem 84 thereby insuring that only gaseous propane enters the channel 86 to pass through the needle valve assembly of propane valve 6 and out the outlet 96. Thus, in operation, the operator is free to move the oxypropane torch of the invention in a number of ways and to dispose the tip downwardly to heat work pieces disposed at a level lower than that of the oxypropane torch itself. Continuous operation is insured owing to the fact that the liquid propane stays within the cylinder 38 assuring a continuous gaseous supply of propane to the nozzle conduit 38 together with the oxygen from cylinder 36.

It will be apparent from the foregoing that there is provided a unique unitary assembly of simple construction which guarantees operation of the torch at a wide variety of positions of the nozzle and its related conduits. Moreover, the apparatus can be readily held by the operator who is constantly apprised of the pressure within the oxygen cylinder. Nevertheless, regulation of the oxygen pressure and/or propane supply is facilitated by virtue of the fact that the regulator knobs 14 and 16 are disposed exteriorly of the housing 12. This permits maximum utilization of the assembly. The valve-handle assembly can be readily made and can be reused simply by removing spent gaseous tanks 36 and 38. The continued use of the apparatus is insured because the valve bodies are protected by virtue of the cover member 12 and the end plates 8 and 10.

The nozzle 32 (FIG. 1) preferably includes a porous sintered insert which aids in preventing backfire of the torch in operation. Also, because propane conduit 96 joins nozzle conduit 28 at 112 downstream of oxygen valve 4, a backflow of propane fuel into the oxygen supply is effectively prevented during normal operation.

While propane fuel has been referred to in the foregoing, other generally equivalent fuels such as butane can also be used.

What is claimed is:

1. Portable hand-held oxypropane torch comprising a generally rectangular planar sheet of material forming a carrier member having openings adjacent opposite ends, oxygen valve means and propane valve means supported on the carrier member each in one of said openings each of said valve means including means for attaching a tank of fuel or oxygen, said sheet of material including a bent end portion forming an integral handle connected to the carrier member, a nozzle conduit, means connecting said oxygen valve means for gaseous fluid communication to the nozzle conduit, a propane conduit connected at one end to said propane valve means and connected at the other end thereof in gaseous fluid communication with said nozzle conduit downstream from the point where the oxygen valve means is connected to the nozzle conduit and a nozzle terminating said nozzle conduit.

2. Torch of claim 1 wherein said oxygen valve comprises (a) a valve body having an inlet adapted to receive oxygen from a container, an outlet, a diaphragm chamber and a valve chamber positioned between said inlet and outlet and communicating therewith and with said diaphragm chamber;

(b) a flexible diaphragm in said diaphragm chamber, the inner side of which is subjected to the pressure at said outlet and the outer side of which is subject to ambient pressure;

(c) a tire core regulator valve seated in said valve chamber and adapted in the closed position to cut off the flow of gas therethrough;

(d) a valve stem connected to said tire core valve and adapted to be actuated by the inner side of said diaphragm;

(e) an actuating spring retainer positioned to contain said spring against said diaphragm in a manner such that said diaphragm operates to effect movement of said valve from full-open to full-closed;

(f) stop means associated with said spring retainer and adapted to restrict the upward motion thereof; and (g) a finger-adjustable control knob operating on said retainer and adapted to permit graduated positioning thereof at positions intermediate of said full-open and full-closed positions.

3. Torch of claim 1 wherein said nozzle conduit is substantially straight and joins a downwardly inclined end portion terminating in said nozzle.

4. Torch of claim 3 wherein said nozzle conduit is substantially straight and joins said downwardly inclined end portion at an angle of between 90° and 180°.

5. Torch according to claim 3 including propane and oxygen cylinders connected to the respective valve means on the underside of the carrier.

6. Torch of claim 5 wherein a pressure gauge is attached to said oxygen valve means for measuring and displaying the pressure in the oxygen cylinder.

7. Torch of claim 1 wherein said propane valve means comprises a tap connection receptive of a cylinder of propane with a closure valve and having an elongated hollow stem forming a gas inlet and defining a pressure contact for opening activation of the closure valve on said propane cylinder, a gas outlet and an adjustable shut-off valve means positioned in said gas inlet between said gas inlet and said gas outlet.

8. Torch of claim 1 wherein said carrier has, at opposed ends thereof, integrally vertical members.

9. Torch of claim 8 wherein said handle is integral with the vertical member of the rearwardly disposed member and descends therefrom, said handle carrying a heat insulated material.

10. Torch of claim 1 wherein over a portion of said oxygen and propane valve means there is a rectangular housing attached to said carrier.

11. Torch of claim 4, wherein said propane valve means comprises a tap connection having an elongated hollow stem extending into a propane cylinder above the liquid level thereof when the cylinder is upright, wherein the oxygen valve means and the propane valve means receptive of oxygen and propane cylinder respective and are disposed in series along the axis of the nozzle conduit with the propane valve means furthest from the nozzle and wherein the nozzle conduit is configured for a given length oxygen and propane cylinder to prevent the liquid level in the propane cylinder from covering the stem when a portion of the outer circumference of the oxygen cylinder is pivoted on a given plane.

* * * * *